US009592893B2

(12) United States Patent
Kroeger et al.

(10) Patent No.: US 9,592,893 B2
(45) Date of Patent: Mar. 14, 2017

(54) WATERCRAFT LAUNCHING AND STORAGE SYSTEM

(71) Applicant: Kroeger Marine Construction, Inc., Seneca, SC (US)

(72) Inventors: David Kroeger, Seneca, SC (US); Benjamin Kroeger, Seneca, SC (US)

(73) Assignee: Kroeger Marine Construction, Inc., Seneca, SC (US)

( * ) Notice: Subject to any disclaimer, the term of this patent is extended or adjusted under 35 U.S.C. 154(b) by 0 days.

(21) Appl. No.: 14/853,426

(22) Filed: Sep. 14, 2015

(65) Prior Publication Data

US 2016/0083059 A1 Mar. 24, 2016

Related U.S. Application Data

(60) Provisional application No. 62/052,007, filed on Sep. 18, 2014.

(51) Int. Cl.

| | |
|---|---|
| ***B63B 23/02*** | (2006.01) |
| ***B63C 15/00*** | (2006.01) |
| ***B63C 3/12*** | (2006.01) |

(52) U.S. Cl.

CPC ..... *B63C 15/00* (2013.01); *B63C 3/12* (2013.01)

(58) Field of Classification Search

USPC .... 405/1, 3; 114/44, 48, 258, 259, 263, 365, 114/366

See application file for complete search history.

(56) References Cited

U.S. PATENT DOCUMENTS

| | | | | |
|---|---|---|---|---|
| 4,763,593 | A | 8/1988 | Lasko | |
| 6,038,994 | A * | 3/2000 | Ford | B63B 23/32 114/259 |
| 6,089,174 | A * | 7/2000 | Slikkers | B63B 23/30 114/259 |
| 8,137,028 | B2 | 3/2012 | Wrobbel | |
| 2012/0251242 | A1 | 10/2012 | Kollar | |

FOREIGN PATENT DOCUMENTS

| | | |
|---|---|---|
| CA | 2762553 | 6/2012 |

* cited by examiner

*Primary Examiner* — Sean Andrish

(74) *Attorney, Agent, or Firm* — McNair Law Firm, P.A.; Douglas W. Kim

(57) ABSTRACT

This invention is directed to a watercraft launch and storage assembly including: a mounting assembly; a first step; a watercraft cage pivotally carried by the mounting assembly having a launch position and a storage position; a continuous loop included in the watercraft cage for receiving and surrounding at least a portion of a watercraft; and, a watercraft cage plane defined through the watercraft cage that is generally perpendicular to the waterline when the watercraft cage is in the storage position so that when a watercraft is received by the watercraft cage and in the storage position an angle defined between a plane running through the width of the watercraft and the watercraft cage plane is greater than 90° reducing the amount of water and debris that can enter the watercraft in the storage position.

20 Claims, 6 Drawing Sheets

WATERCRAFT LAUNCHING AND STORAGE SYSTEM

BACKGROUND OF THE INVENTION

1) Field of the Invention

The present invention relates to a watercraft launch and storage system that can mount to the side of a dock. It provides a safe and easy entry and exit point for riders of watercraft (such as kayaks, canoes, paddle boards, surfboards, certain sailboats, paddleboats, sculls, and the like) and provides secure storage for the watercraft when not in use.

2) Description of Related Art

Launching and retrieving watercraft such as a kayak from a dock, especially a floating dock, can be difficult and dangerous because of the height of the dock above the water line and due to the need to step down into an unstable platform such as a floating watercraft. Kayakers especially are often injured, falling into the water, or damaging their kayaks during the process of launching and retrieving the watercraft.

One attempt to provide a system for launching kayaks is United States Patent Application 2012/0251242 A1 that utilizes a winch and strap system to raise and lower the launch platform. However, the strap is an inconvenience and a potential safety hazard. Further, this device does not provide kayak storage. The device also utilizes an expanded metal grating on which the user may stand, but it can damage the bottom of the kayak by scraping, and is too large for certain installations. Part of the device rests below the waterline at all times, which will promote corrosion and fouling of the device. A large portion of the device mounts to the top of a dock using a metal strap and bolts, thus posing a trip hazard and burn hazard on hot days.

U.S. Pat. No. 4,763,593 is directed to a mechanical device for lifting, storing, and launching small boats in and out of the water alongside conventional dry docks. This device provides for storage, but does not enable safe entry and exit, so the small boat must be taken to a separate and safe location for entering and exiting.

U.S. Pat. No. 8,137,028 is directed to a racking system that does not provide for a safe entry or exit access point. In fact, the rider must float the canoe or kayak into the cradle and lift it into a secure vertical storage position on the side of the dock and does not get on the dock.

Canadian patent 2,762,553 is directed to a cradle that is used to enter and exit the watercraft. This device does not provide storage for the watercraft, and the watercraft must first be removed from the storage device before raising the device out of the water. The device also does not provide access steps which could improve safety. Nor does the device provide a post or handrail on which to rely for leverage during entry and exit.

Accordingly, it is an object of the present invention to provide for a watercraft launching platform to better stabilize the watercraft when the user enters and exits the craft.

It is another object of the present invention to provide for an apparatus for launching and storing watercraft.

SUMMARY OF THE INVENTION

The above objectives are accomplished according to the present invention by providing a watercraft launch and storage assembly comprising: a mounting assembly that can be removabley attached to a dock; a first step attached to the mounting assembly and vertically movable relative to the mounting assembly and above a waterline; a watercraft cage pivotally carried by the mounting assembly having a launch position and a storage position; a continuous loop included in the watercraft cage for receiving and surrounding at least a portion of a watercraft; and watercraft cage plane defined through the watercraft cage that is generally perpendicular to the waterline when the watercraft cage is in the storage position so that when a watercraft is received by the watercraft cage and in the storage position an angle defined between a plane running through the width of the watercraft and the watercraft cage plane is greater than 90° reducing the amount of water and debris that can enter the watercraft in the storage position.

The invention can include a pull cord with a distal end attached to a distal area of the watercraft cage for positioning the watercraft cage from the launch position to the storage position. The cage can include a partial loop for partially receiving and surrounding at least a portion of the watercraft. A proximal support can be attached between the continuous loop and the partial loop; and, a stop for contacting the proximal support when the watercraft cage is in the launch position thereby preventing the watercraft cage from over rotating.

The invention can include a post that carries a proximal end of the pull cord attached to the mounting assembly. A handle can be attached to the post. The handle can be slideably attached to the post and can be removed from the post. A second step can be attached to the mounting assembly and vertically movable relative to the mounting assembly and below the waterline. A cleat attached to the mounting assembly for securing the pull cord to retain the watercraft cage in the storage position. The cleat can be a marine cleat, hook, ring or the like. The cleat can be attached to the post, handle, mounting assembly or dock. A winch carried by the mounting assembly and attached to the proximal end of the pull cord for positioning the watercraft cage between the launch position and the storage position when the winch is actuated can be included. The winch can be attached to the post or on the dock.

BRIEF DESCRIPTION OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein.

Figure 1:
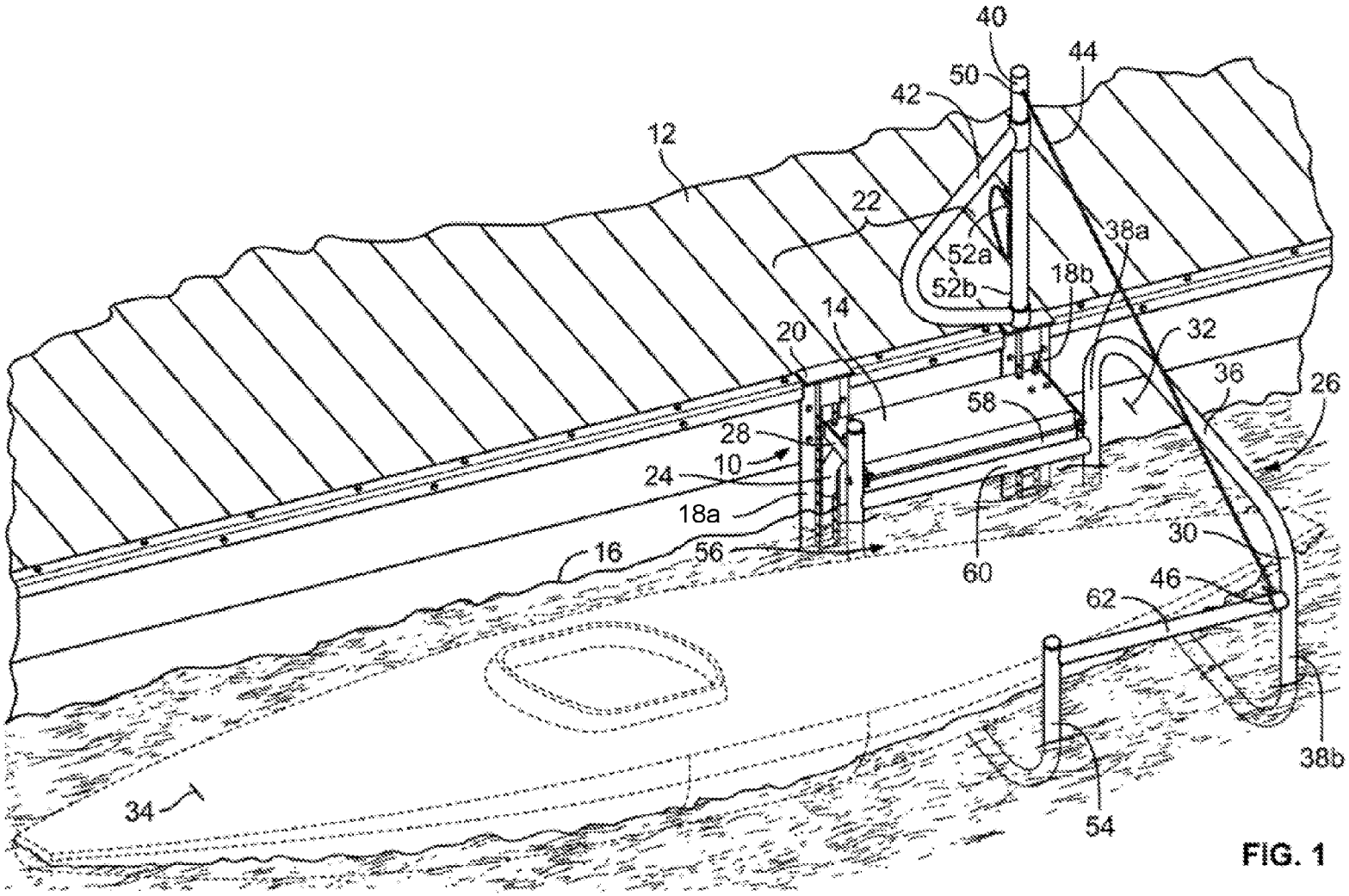
FIG. 1 shows a perspective view of aspects of the invention.

It will be understood by those skilled in the art that one or more aspects of this invention can meet certain objectives, while one or more other aspects can meet certain other objectives. Each objective may not apply equally, in all its respects, to every aspect of this invention. As such, the preceding objects can be viewed in the alternative with respect to any one aspect of this invention. These and other objects and features of the invention will become more fully apparent when the following detailed description is read in conjunction with the accompanying figures and examples. However, it is to be understood that both the foregoing summary of the invention and the following detailed description are of a preferred embodiment and not restrictive of the invention or other alternate embodiments of the invention. In particular, while the invention is described herein with reference to a number of specific embodiments, it will be appreciated that the description is illustrative of the invention and is not constructed as limiting of the invention. Various modifications and applications may occur to those who are skilled in the art, without departing from the spirit and the scope of the invention, as described by the appended claims. Likewise, other objects, features, benefits and advantages of the present invention will be apparent from this summary and certain embodiments described below, and will be readily apparent to those skilled in the art. Such objects, features, benefits and advantages will be apparent from the above in conjunction with the accompanying examples, data, figures and all reasonable inferences to be drawn therefrom, alone or with consideration of the references incorporated herein.

DETAILED DESCRIPTION OF A PREFERRED EMBODIMENT

With reference to the drawings, the invention will now be described in more detail. Unless defined otherwise, all technical and scientific terms used herein have the same meaning as commonly understood to one of ordinary skill in the art to which the presently disclosed subject matter belongs. Although any methods, devices, and materials similar or equivalent to those described herein can be used in the practice or testing of the presently disclosed subject matter, representative methods, devices, and materials are herein described.

Unless specifically stated, terms and phrases used in this document, and variations thereof, unless otherwise expressly stated, should be construed as open ended as opposed to limiting. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise.

Furthermore, although items, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

Referring to FIG. 1, a mounting assembly is shown generally as 10 attached to a dock 12. A first step 14 is carried by the mounting assemble and in one embodiment the disposed above the water line 16. The mounting assembly can include lateral vertical brackets 18*a* and 18*b* that attach to the dock. A upper plate 20 can be attached to the lateral vertical brackets and positioned generally level with the top surface of the dock. Therefore, a space 22 is provided between the mounting assembly removing metal from the access path of the rider. When metal is heated by the sun, it can result in a burn hazard to users of the watercraft. Providing the space eliminates the risk from the path of the user.

The mounting assembly can include a bracket 24 that is vertically adjustable on the mounting assembly to adjust the height of the step relative to the water or dock. The step can therefore be adjusted for ease of use to provide an advantageous distance between the top of the dock, the step and the watercraft when the watercraft is floating on the water.

A watercraft cage shown generally as 26 can be pivotally attached to the mounting assembly or step or step rail 28 allowing the watercraft cage to move between a launch position and a storage position. In the launch position, the watercraft cage can be partially submerged in the water. A continuous loop 30 can be included in the watercraft cage and define an opening 32 for receiving a watercraft such as a kayak 34. The continuous loop can surround at least a portion of the watercraft. Additionally, the top portion 36 of the continuous loop can provide for a support for the user when entering or exiting the watercraft. The sides 38*a* and 38*b* can limit the motion of the watercraft when it is in the continuous loop to assist with stabilization of the watercraft when it is floating and the user is attempting to enter or exit the watercraft. The continuous loop can completely surround a portion of the watercraft as shown.

A post 40 can be attached to the mounting assembly or to the dock to provide additional support to the user when entering or exiting the watercraft. The post can include a handle 42 that is attached to the post to further provide support to the user. The handle can be slideably attached to the post allowing the height of the handle relative to the top of the dock to be adjusted.

A pull cord 44 can include a distal end 46 attached to the watercraft cage so that when the pull cord is pulled, the watercraft cage can be positioned from the launch position to the storage position. The pull cord can be received through an opening 50 in the post and secured to a cleat 52*a* attached to the post or a cleat 52*b* attached to the mounting assembly or the dock. In one embodiment, a winch can be attached to the post, mounting assembly or dock and be used to pull or release the pull cord to position the watercraft cage between the launch and storage positions.

A partial loop 54 can be included in the watercraft cage with an upper opening 56 defined by the partial loop. The watercraft can be received into the partial loop to increase stability of the watercraft for the user when entering or exiting the watercraft.

A stop 58 can be carried by the mounting assembly and attached to the step in one embodiment. A proximal support 60 can be included in the watercraft cage and when the watercraft cage is in the launch position, the proximal support contacts the stop and prevents the watercraft cage from over rotation. A distal support can be included in the watercraft cage for supporting the continuous and partial loops. The pull cord can be attached to the distal support in one embodiment and can be attached adjacent to the continuous loop to provide for a generally linear travel path of the pull cord when the pull cord is pulled.

Figure 2:
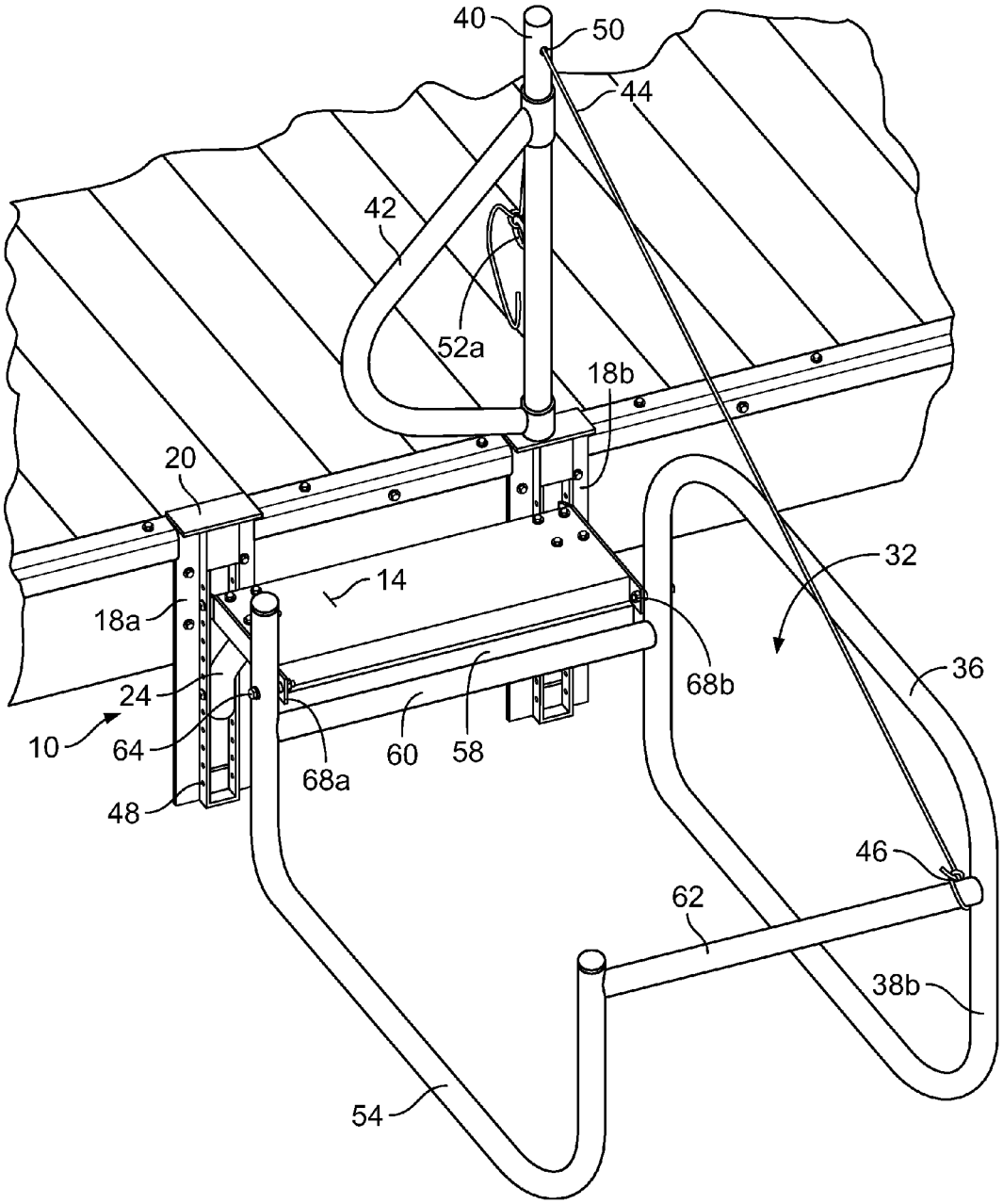
FIG. 2 shows a perspective view of aspects of the invention.

Referring to FIG. 2, the mounting assembly can include openings such as 48 vertically arranged allowing the bracket 24 to be attached at different distances from the top of the dock or the water line. The step can also be attached to the openings to position the step at varying distances from the top of the dock or water line. The mounting assembly can extend below the water line in one embodiment. The watercraft cage can rotate about pivot 64 between the launch and storage position. The step can include extensions 68*a* and 68*b* where the watercraft can be pivotally attached.

Figure 3:
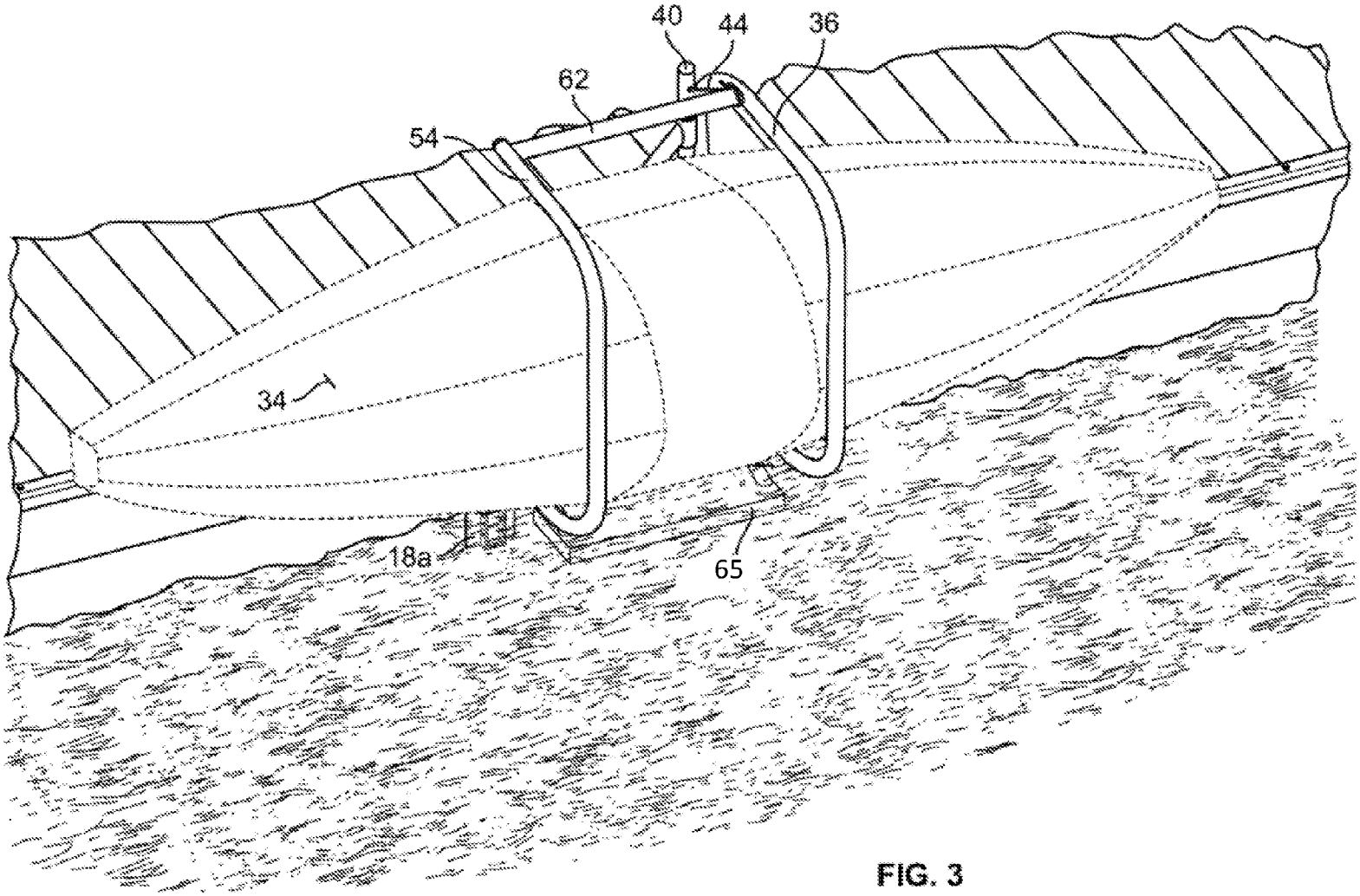
FIG. 3 shows a perspective view of aspects of the invention.

Referring to FIG. 3, the watercraft cage is shown in a storage position with the watercraft resting in the watercraft cage. The pull cord is pulled causing the watercraft cage to rotate out of the water and therefore lift the watercraft out of the water. A second or lower step 65 can be carried by the mounting assembly or attached to the stop or the first step and can be disposed below the water line to assist the user with entering or exiting the watercraft. A outward cross bar 62 can connect the continuous loop and the partial loop.

Figure 4:
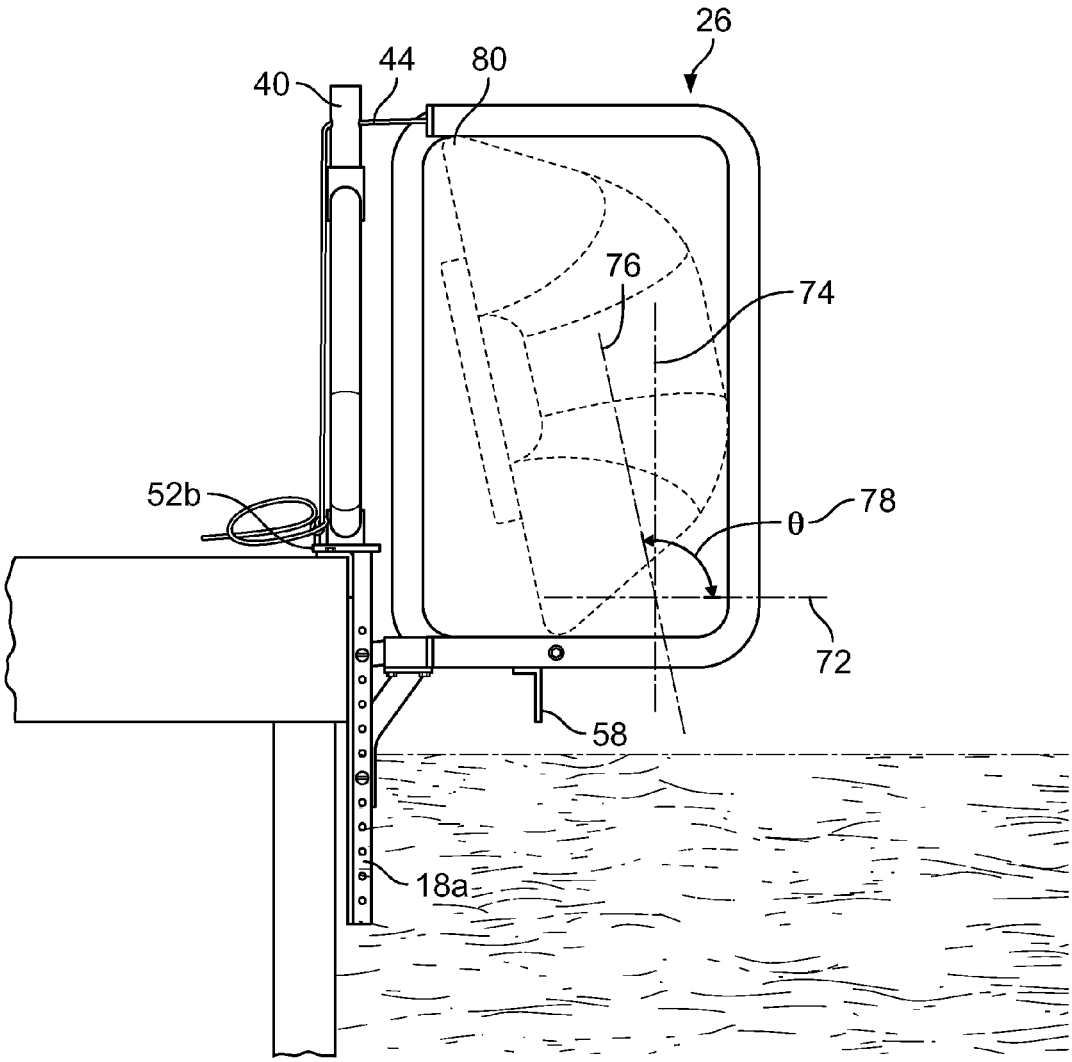
FIG. 4 shows a side view of aspects of the invention.

Referring to FIG. 4, the watercraft is in the watercraft cage in the storage position. A watercraft width plane is generally parallel to a horizontal plane 72 when the watercraft is in the launch position. When the watercraft cage is positioned into the storage position, the watercraft plane can pass through vertical position 74 where the watercraft width plane arrives at an obtuse position 76 when the watercraft cage is in the storage position. An angle Θ shown as 78 is greater than 90° relative to the horizontal plane when the watercraft cage is in the storage position. In the storage position, the top of the watercraft is positioned generally under the right or top edge 80 of the watercraft thereby sheltering the opening in the top of the watercraft from solids and liquids entering the opening in the watercraft. For example, rain can be prevented from entering the cockpit opening when a kayak is in the storage position.

Figure 5:
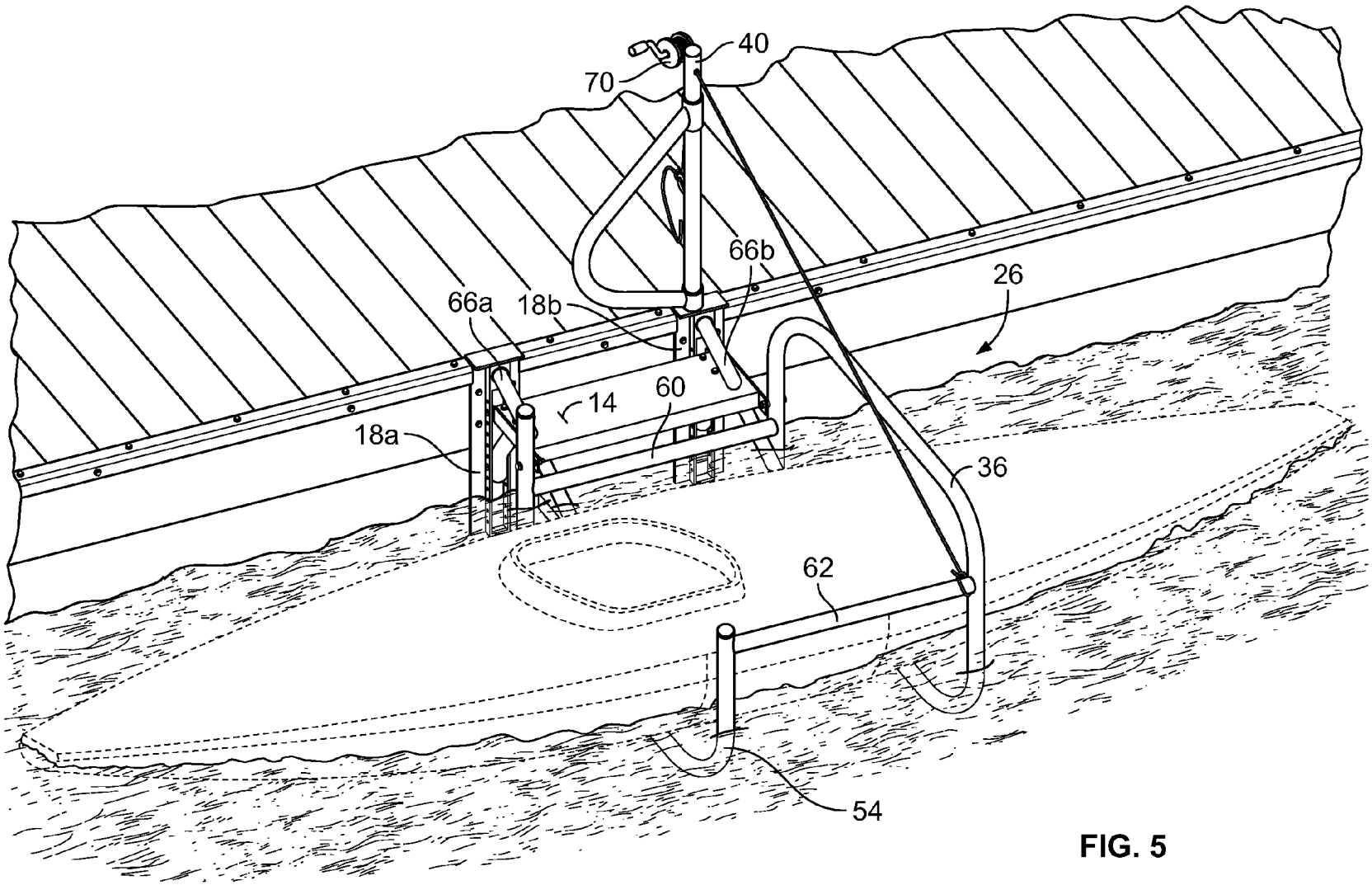
FIG. 5 shows a perspective view of aspects of the invention.

Referring to FIG. 5, one embodiment is shown including rails 66*a* and 66*b* that are attached to the mounting assembly above the upper step and extend through the upper step into the water. The proximal support contacts the rails and prevents the watercraft cage from over rotating into the water and supports the watercraft cage in a launch position. The rails can also support the lower step below the waterline. In one embodiment, the proximal end of the pull cord can be attached to a winch 70 to assist with positioning the watercraft cage between the launch and the storage position. For some watercraft, the force needed to position the watercraft cage with the watercraft contained in the cage requires the use of a winch.

Figure 6:
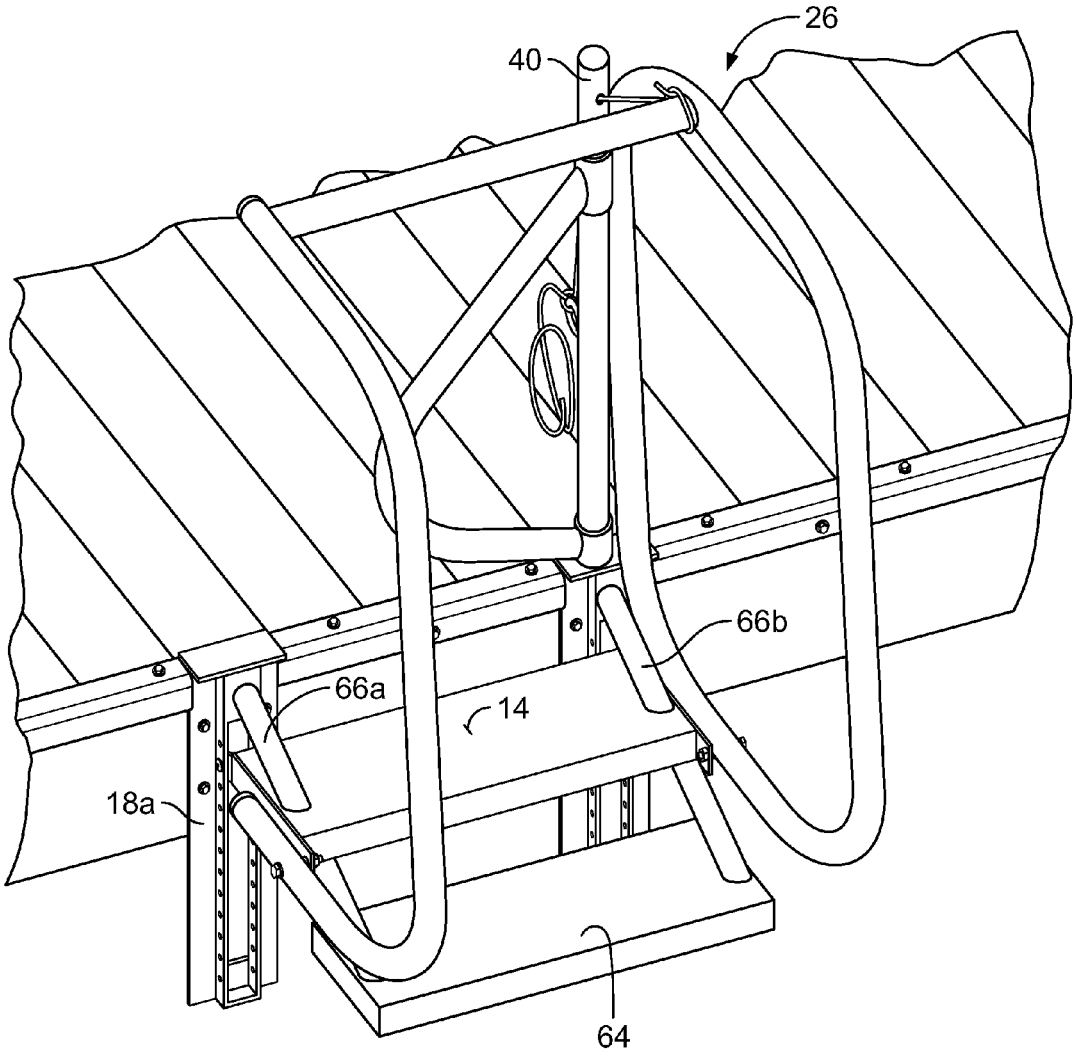
FIG. 6 shows a perspective view of aspects of the invention.

Referring to FIG. 6, one embodiment is shown with rails 66*a* and 66*b* attached to the mounting assembly above the upper step 14, extending through the upper step and attached to a lower step 64. The watercraft cage is shown in the storage position. The continuous loop and partial loop receive the watercraft so that the continuous loop supports the watercraft in the storage position, above the waterline and also allows the cockpit cover to be at least partially protected by the top edge of the watercraft. The handle can be removed from the post by sliding the handle upwards.

While the present subject matter has been described in detail with respect to specific exemplary embodiments and methods thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art using the teachings disclosed herein.

What is claimed is:

1. A watercraft launch and storage assembly comprising:

a mounting assembly that can be removabley attached to a dock;

a first step attached to the mounting assembly and vertically movable relative to the mounting assembly and above a waterline;

a watercraft cage pivotally carried by the mounting assembly having a launch position and a storage position;

a continuous loop included in the watercraft cage for receiving and completely surrounding a cross section portion of the watercraft orthogonal to a length of the watercraft;

a partial loop included in the watercraft cage having an upper opening configured to receive a portion of the watercraft and allow a user to position the user and watercraft in the watercraft cage while the user is positioned in the watercraft and the watercraft cage is in the launch position; and, a watercraft cage plane defined through the watercraft cage that is generally perpendicular to the waterline when the watercraft cage is in the storage position so that when a watercraft is received by the watercraft cage and in the storage position an angle defined between a plane running through the width of the watercraft and the watercraft cage plane is greater than 90° reducing the amount of water and debris that can enter the watercraft in the storage position.

2. The assembly of claim 1 including a pull cord with a distal end attached to a distal area of the watercraft cage for positioning the watercraft cage from the launch position to the storage position.

3. The assembly of claim 1 including a partial loop included in the watercraft cage for partially receiving and surrounding at least a portion of the watercraft.

4. The assembly of claim 3 including:

a proximal support attached between the continuous loop and the partial loop; and, a stop for contacting the proximal support when the watercraft cage is in the launch position thereby preventing the watercraft cage from over rotating.

5. The assembly of claim 1 including a post that carries a proximal end of the pull cord attached to the mounting assembly.

6. The assembly of claim 5 including a handle attached to the post.

7. The assembly of claim 6 wherein the handle is slideably attached to the post and can be removed from the post.

8. The assembly of claim 1 including a second step attached to the mounting assembly and vertically movable relative to the mounting assembly and below the waterline.

9. The assembly of claim 1 including a cleat attached to the mounting assembly for securing the pull cord to retain the watercraft cage in the storage position.

10. The assembly of claim 1 including:

a pull cord having a distal end attached to a distal area of the watercraft cage; and, a winch carried by the mounting assembly and attached to the proximal end of the pull cord for positioning the watercraft cage between the launch position and the storage position when the winch is actuated.

11. A watercraft launch and storage assembly comprising:

a mounting assembly that can be removabley attached to a dock;

a continuous loop pivotally attached to the mounting assembly for receiving and completely surrounding a portion of a watercraft orthogonal in relation to a length of the watercraft and having a launch position and a storage position; and, a partial loop attached to the continuous loop for partially receiving and surrounding at least a portion of the watercraft configured to allow a user and watercraft to enter and exit the watercraft cage when the user is positioned the in the watercraft and the watercraft is in the launch position.

12. The assembly of claim 11 including a first step attached to the mounting assembly.

13. The assembly of claim 11 including a continuous loop plane defined through the continuous loop is generally perpendicular to the waterline when the continuous loop is in the storage position so that when a watercraft is received by the continuous loop and in the storage position an angle defined between a plane running through the width of the watercraft and the continuous loop plane is greater than 90°.

14. The assembly of claim 11 including:

a proximal support attached between the continuous loop and the partial loop; and, a stop for contacting the proximal support when the watercraft cage is in the launch position thereby preventing the watercraft cage from over rotating.

15. The assembly of claim 11 including:

a proximal support attached between the continuous loop and the partial loop;

a pull cord attached to the partial loop for positioning the continuous loop between the launch position and the storage position; and, a cleat included in the mounting assembly for securing the pull cord to the mounting assembly thereby securing the continuous loop in the storage position.

16. The assembly of claim 11 including a distal support attached between the continuous loop and the partial loop.

17. The assembly of claim 16 including a stop plate carried by the mounting assembly for contacting the distal support preventing the continuous loop from over rotating when in the launch position.

18. A watercraft launch and storage assembly comprising:

a mounting assembly that can be attached to a dock;

a step attached to the mounting assembly positioned above a waterline when the mounting assembly is attached to the dock;

a watercraft cage pivotally attached to the step and having a continuous loop defining an opening for receiving the watercraft lengthwise, partial loop for receiving the watercraft and configured to position a user in the watercraft cage while the user is positioned in the watercraft, distal support and proximal support;

a stop attached to the step and contacting the proximal support when the watercraft cage is in a launch position to prevent the watercraft cage from over rotating; and, a pull cord attached to the distal support so that the watercraft cage can be positioned between the launch position and a storage position so when in the storage position, an angle defined by a continuous loop plane defined through the continuous loop generally perpendicular to the waterline when the continuous loop is in the storage position and a plane running through the width of the watercraft and the continuous loop plane is greater than 90°.

19. The apparatus of claim 18 including a step support connected to the step and mounting assembly.

20. The apparatus of claim 18 including a cleat attached to the mounting support for securing the pull cord and watercraft cage in the storage position.

* * * * *